US010894259B2

(12) United States Patent
Mackel et al.

(10) Patent No.: US 10,894,259 B2
(45) Date of Patent: Jan. 19, 2021

(54) SEPARATOR WITH A DOUBLE-CONICAL CENTRIFUGING CHAMBER

(71) Applicant: GEA MECHANICAL EQUIPMENT GMBH, Oelde (DE)

(72) Inventors: Wilfried Mackel, Lippetal-Herzfeld (DE); Angelika Voltmann, Rheda-Wiedenbrück (DE)

(73) Assignee: GEA MECHANICAL EQUIPMENT GMBH, Oelde (DE)

( * ) Notice: Subject to any disclaimer, the term of this patent is extended or adjusted under 35 U.S.C. 154(b) by 290 days.

(21) Appl. No.: 16/078,886

(22) PCT Filed: Feb. 17, 2017

(86) PCT No.: PCT/EP2017/053624
§ 371 (c)(1),
(2) Date: Aug. 22, 2018

(87) PCT Pub. No.: WO2017/153150
PCT Pub. Date: Sep. 14, 2017

(65) Prior Publication Data

US 2019/0046996 A1 Feb. 14, 2019

(30) Foreign Application Priority Data

Mar. 8, 2016 (DE) ..... 20 2016 101 272 U

(51) Int. Cl.
*B04B 1/14* (2006.01)
*B04B 1/08* (2006.01)
(Continued)

(52) U.S. Cl.
CPC ..... *B04B 1/14* (2013.01); *B04B 1/08* (2013.01); *B04B 7/04* (2013.01); *B04B 7/08* (2013.01)

(58) Field of Classification Search
CPC .... B04B 1/14; B04B 7/04; B04B 1/08; B04B 7/08
See application file for complete search history.

(56) References Cited

U.S. PATENT DOCUMENTS 1,485,235 A * 2/1924 Mauss ..... B04B 1/14 494/48
2,731,331 A * 1/1956 Strezynski ..... B04B 5/06 422/259
(Continued)

FOREIGN PATENT DOCUMENTS

CH 256048 A * 7/1948 ..... B04B 1/14
DE 335061 C * 3/1921 ..... B04B 1/14
(Continued)

OTHER PUBLICATIONS

International Search Report dated Jun. 1, 2017 in related International Application No. PCT/EP2017/053624.
(Continued)

*Primary Examiner* — Charles Cooley
(74) *Attorney, Agent, or Firm* — Patent Portfolio Builders PLLC

(57) ABSTRACT

A separator with a rotating system includes a drum with a vertical axis of rotation, which drum is rotatable during operation, and a drum inner chamber subdivided into a lower double-conical centrifuging chamber and an upper double-conical centrifuging chamber. Both centrifuging chambers have solids discharge openings that are openable and closable in the lower centrifuging chamber by a piston slide and in the upper centrifuging chamber by an auxiliary slide. The mass moment of inertia $J_Q$ of the rotating system about a transverse axis Q extending through the center of gravity S of the rotating system of the drum and which is perpendicular to the vertical axis of rotation D is greater than the mass
(Continued)

Figure 1:
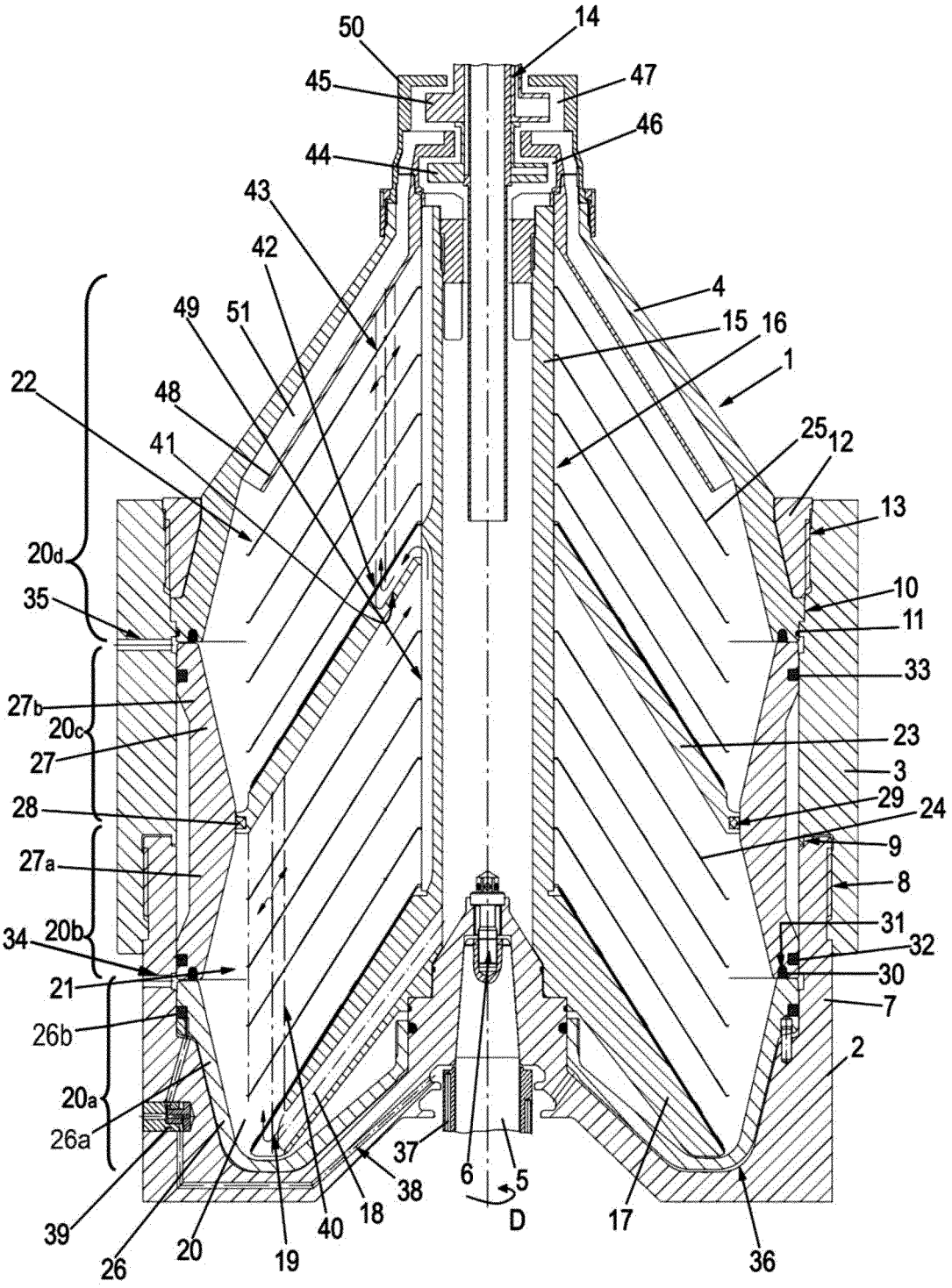

moment of inertia $J_D$ of the rotating system about the vertical axis of rotation D of the rotating system.

12 Claims, 2 Drawing Sheets

(51) Int. Cl.
*B04B 7/08* (2006.01)
*B04B 7/04* (2006.01)

(56) References Cited

U.S. PATENT DOCUMENTS

| | | | | | |
|---|---|---|---|---|---|
| 3,081,028 | A * | 3/1963 | Steinacker | ..... | B04B 1/14 494/27 |
| 3,117,928 | A | 1/1964 | Thylefors | | |
| 3,125,516 | A | 3/1964 | Kaldewey | | |
| 2019/0046996 | A1 * | 2/2019 | Mackel | ..... | B04B 7/08 |

FOREIGN PATENT DOCUMENTS

| | | | | | |
|---|---|---|---|---|---|
| DE | 573698 | C * | 4/1933 | ..... | B04B 1/14 |
| DE | 1057535 | B | 5/1959 | | |
| DE | 1141951 | B | 12/1962 | | |
| DE | 1146451 | B | 3/1963 | | |
| DE | 2938628 | A1 | 3/1981 | | |
| DE | 102009019392 | A1 | 11/2010 | | |
| JP | S5038858 | A | 4/1975 | | |
| RU | 2136384 | C1 * | 9/1999 | ..... | B04B 1/14 |
| RU | 2158188 | C2 * | 10/2000 | ..... | B04B 1/12 |

OTHER PUBLICATIONS

Search Report dated Oct. 4, 2016 in related DE Application No. 20 2016 101 272.4.
Written Opinion dated Jun. 1, 2017 in related International Application No. PCT/EP2017/053624.

* cited by examiner

SEPARATOR WITH A DOUBLE-CONICAL CENTRIFUGING CHAMBER

BACKGROUND AND SUMMARY OF THE INVENTION

Exemplary embodiments of the invention relate to a separator with a rotating system, which has a drum with a vertical axis of rotation, which drum is rotatable during operation and has a drum inner chamber that is subdivided into a lower double-conical centrifuging chamber and an upper double-conical centrifuging chamber, wherein both centrifuging chambers each have solids discharge openings that are able to be opened up, and closed off, in the lower centrifuging chamber by a piston slide and in the upper centrifuging chamber by an auxiliary slide.

A design of this type is known from DE-PS 1 057 535. According to this document, the centrifuging chamber is formed by two or more double hollow cones that are arranged one above the other, which allows an increase in the clarification capacity to be achieved, with the drum diameter remaining the same. The construction has in itself proven to be successful, but should be developed further in terms of construction and with regard to its functionality.

DE 1 141 951 A1 discloses a separator having a drum in which a separating plate assembly is inserted, wherein the separating plate assembly is subdivided by a separating plate, which has a larger diameter than the other separating plates, into two separating plate assembly sections below and above this separating plate. A product to be processed is fed by way of a supply in the drum shaft and enters the separating chamber via a distributor. In the chamber, the product in turn enters a rising duct of the separating chamber assembly, which duct extends over the entire height of the separating plate assembly. In the chamber below the separating plate, the material for centrifuging which enters the separating chamber is freed of the main part of the sludge, which forms a sludge cushion at the circumference of the separating chamber. The sludge cushion prevents the heavy liquid from passing around the outer edge of the separating plate with larger diameter. In the upper separating plate assembly section, the remaining, light liquid is separated and collected. The separated heavy liquid is discharged from the separating chamber through a duct at a relatively large diameter of the drum, and the separated light liquid is discharged from the separating chamber through a further duct at a relatively small diameter of the drum. The position of the separating plate with the larger diameter can be varied in the separating chamber according to the usage case. According to a preferred exemplary embodiment, the position is approximately at the height of the piston slide openings for discharging solids from the drum.

DE 10 2009 019 392 A1 discloses that in a drum having two separating plate assembly sections arranged vertically one above the other, the one separating plate assembly section is designed as a separating device—or as a combined separating and clarifying device—for separating an inflowing material for centrifuging in the centrifugal area into two liquid phases and, if appropriate, for clarifying of a solids phase, and the other separating plate assembly section is preferably designed exclusively as a clarifying device for clarifying a liquid phase of solids.

Finally, DE 1 146 451 A discloses two double-conical solids collecting chambers in a nozzle separator, which are situated one above the other and from which discharge ducts lead to outlet nozzles which are open at all times during operation and which are situated at a common vertical height.

Exemplary embodiments are directed to improvement in the structural design of the generic centrifuge and to expanding the range of use thereof.

According to an embodiment, the mass moment of inertia $J_Q$ of the rotating system about a transverse axis Q extending through the center of gravity of the rotating system of the drum and which is perpendicular to the vertical axis of rotation D is greater than the mass moment of inertia $J_D$ of the rotating system about the vertical axis of rotation D of the rotating system, in particular greater by more than 1.2 times. This configuration means that, in each case, the separator has a relatively large height relative to the diameter, which, when the drum inner chamber is configured as a two-fold double hollow cone, allows a high clarification capacity by way of separating plates with a relatively large diameter, with the drum diameter remaining the same. Here, the diameter of the drum is kept relatively small in comparison with the height, which inter alia facilitates the production thereof.

It is advantageous if, according to a variant of the invention and also independently inventive variant, the drum inner chamber is subdivided by a conical partitioning plate into the lower double-conical centrifuging chamber and the upper double-conical centrifuging chamber. By contrast to the situation with the generic prior art, the drum inner chamber is completely divided into two separate centrifuging chambers in terms of function, apart from conducting of product, by this partitioning plate, which extends radially outward up to the auxiliary slide and radially inward, preferably up to the distributor, with the result that two-stage separation in the manner of a series arrangement of two centrifugal separating devices is able to be realized easily in only one rotating system.

Preferably, the partitioning plate has a distribution duct for conducting clarified product into the upper centrifuging chamber from the lower centrifuging chamber. The duct advantageously preferably conducts the clarified product, which is to be conducted into the second centrifuging chamber from the first centrifuging chamber, directly to the diameter of at least one rising duct in a separating plate assembly in the second upper centrifuging chamber.

In this way, it is possible, in the region of the lower centrifuging chamber, for the drum to be designed as a clarifier for clarifying a flowable product of solids, and, in the region of the upper centrifuging chamber, for the drum to be designed as a clarifier, or as a combined clarifier and separating device both for clarifying a flowable product of solids and for separating the product into two liquid phases of different density (for example L1 and L2). Because the drum can form two centrifugal clarifiers connected in series, particularly substantial clarification of the product is possible in only one rotating system. Provided for this purpose too are, inter alia, the lower, discontinuously closable solids discharge openings in the lower centrifuging chamber and the axially upper, discontinuously closable solids discharge openings in the upper centrifuging chamber.

For the purpose of optimizing the function of the clarifiers, it is advantageous if, in the lower centrifuging chamber and in the upper centrifuging chamber, there is formed in each case one separating plate assembly, which preferably each have one or more rising ducts. Here, it is in turn preferable for it to be possible for all the rising ducts of the lower separating plate assembly to be situated at a different radius than all the rising ducts of the upper separating plate assembly in order to be able to individually match each of the two clarifiers to the respective clarification task.

According to another optional variant and refinement and also independent invention, the drum has a drum lower part, a drum middle part and a drum upper part or a drum cover, which are arranged vertically one above the other. In this way, a relatively high drum with a somewhat smaller diameter in comparison with the height can be realized more easily than a drum only with a drum lower part and a drum cover, each of which is of conical form.

Here, it is preferable for the drum upper part to be of conical form at least in sections, for the drum middle part to be formed as an externally and internally cylindrical ring segment, and for the drum lower part to be of conical form at least internally in sections.

BRIEF DESCRIPTION OF THE DRAWING FIGURES

Figure 2:
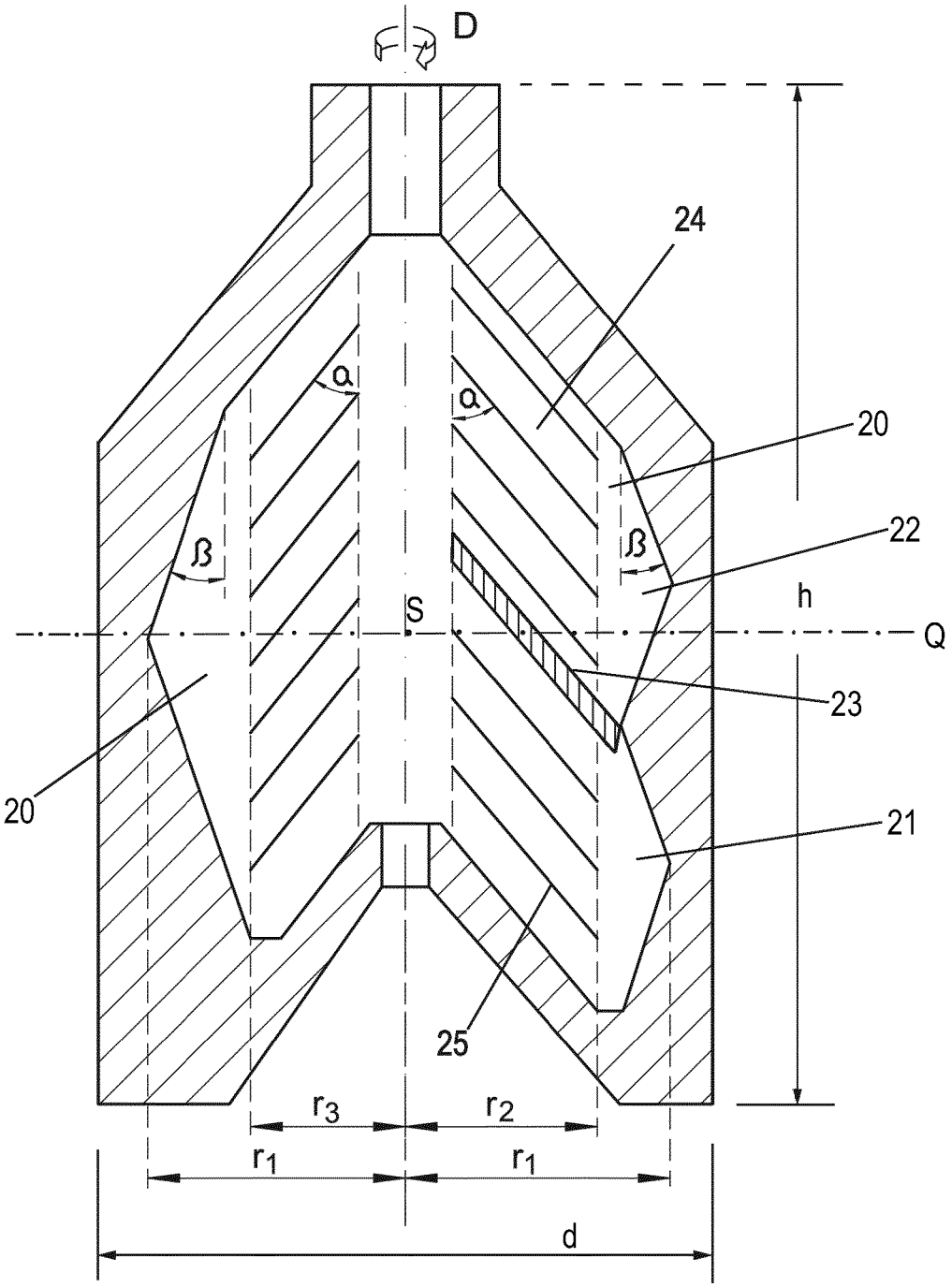

The invention is described in more detail below with reference to the drawing on the basis of an exemplary embodiment. In the drawing:

FIG. 1 shows a section through a drum of a separator drum according to the invention, wherein different operating states are illustrated on the right and left of an axis of rotation D; and FIG. 2 shows the schematic illustration of a known separator drum on the left of an axis of rotation D, and the schematic illustration of a separator drum according to the invention on the right.

DETAILED DESCRIPTION

FIG. 1 shows a rotatable drum 1 of a separator, having a vertical axis of rotation D. The drum forms, together with all further parts which rotate therewith during operation, a rotating system.

The drum 1 has a drum lower part 2, a drum middle part 3 and a drum upper part or a drum cover 4, which are arranged vertically one above the other.

The drum lower part 2 is mounted on an upper end of a vertically oriented drive spindle 5 and is connected rotationally conjointly thereto. Here, the drum lower part 2 and the drive spindle 5 are screwed to one another by way of a screw 6. A drive for the drive spindle is provided below the spindle region shown but is not illustrated here.

The drum middle part 3 is formed as a substantially cylindrical ring segment that is mounted on the drum lower part 2. The drum lower part 2 extends from the drive spindle 5 radially outward, wherein it widens in a downward direction in a conical manner in sections and then merges into a cylindrical section 7 which extends axially upward.

The drum lower part 2 and the drum middle part 3 are connected to one another rotationally conjointly. For this purpose, the drum lower part 2 and the drum middle part 3 are screwed to one another on a thread 8 such that they vertically overlap in sections. Moreover, the drum middle part 3 engages behind the drum lower part 2 internally by way of an axially projecting ring collar 9, which counteracts widening of the drum middle part 3 during operation.

The drum cover 4 has a radially outer ring collar 10 by way of which the cover bears on a corresponding radially inner ring collar 11 of the drum middle part 3. A closure ring 12 presses the drum cover 4 against the drum middle part 3 from above. The closure ring 12 is screwed to the drum middle part 3 on a thread or, here, screwed into it.

A vertically oriented inflow pipe 14 extends vertically from above into the drum 1. The inflow pipe 14 does not rotate with the drum 1 during operation, but rather is stationary. Such stationary parts form no part of the rotating system, to which, rather, all parts of the separator which rotate with the drum belong.

The non-rotating inflow pipe 14 passes through a central opening of the drum cover 4 and, from above, opens vertically into a distributor shaft 15 of a distributor 16. The distributor 16 is formed as a part which rotates with the drum 1 during operation. The inflow pipe 14 and the distributor shaft 15 are therefore formed to be radially spaced apart from one another.

At its lower end, the distributor 16 goes to a conically widening distributor section 17. In the distributor section 17, one or more distributor ducts 18 are formed. The distributor ducts 18 extend radially outward in an oblique manner with respect to the axis of rotation. At their outer ends, they each have an outlet opening 19. In this way, a product which is fed through the inflow pipe 14 into the rotating distributor shaft 15 and into the distributor ducts 18 is accelerated to circumferential speed in the distributor and then conducted into the drum inner chamber 20.

The drum inner chamber 20 has, at any rate in its radially outer region, the contour of a two-fold double hollow cone. This means that, vertically from bottom to top, the drum inner chamber 20 initially widens conically in a first section 20*a*, then tapers conically in a second section 20*b*, then widens conically again in a third section 20*c*, and then tapers conically again in a fourth section 20*d*.

Here, the first and the second sections 20*a, b* form a lower centrifuging chamber 21, and the third and the fourth sections 20*c*, 20*d* form an upper centrifuging chamber 22.

The two centrifuging chambers 21, 22 are radially separated from one another by a conical partitioning plate 23.

In each of the two centrifuging chambers 21, 22, which are arranged vertically one above the other, there is formed in each case one separating plate assembly 24, 25 composed of separating plates that are stacked one above the other and which are in each case axially separated from one another by a gap. The axial spacing of the separating plates of each plate assembly 24, 25 may be realized in any desired way, for example by way of stamped lugs (not illustrated here).

Furthermore, a vertically lower piston slide 26 and an auxiliary slide 27 arranged vertically thereabove are arranged in the drum inner chamber 20. The piston slide 26 and the auxiliary slide 27 each have a ring-like form. They are each arranged vertically in the drum inner chamber 20 so as to be movable, here displaceable, in a limited manner.

The piston slide 26 has an outer conical section 26*a*. Formed on its outer edge is a sealing ring 26*b* which seals off a gap between the piston slide 26 and the drum lower part 2. By contrast, the auxiliary slide 27 is of double-conical form. The auxiliary slide initially tapers toward the center in a lower section 27*a*, and then widens again in an upper section 27*b*. Preferably, the partitioning plate 23 extends radially up to the auxiliary slide 27 in the region of the smallest inner diameter of the latter. In this case, a sealing ring 28 is arranged between the partitioning plate 23 and the auxiliary slide 27. Here, the sealing ring 28 is inserted in a ring-shaped groove 29 on the outside of the partitioning plate 23. This prevents flow of liquid in this region from the lower centrifuging chamber 21 into the upper centrifuging chamber 22 in a simple manner, which is advantageous for functionally separating the centrifuging chambers 21, 22 to a sufficient extent.

A further sealing ring 30 is formed here between the piston slide 26 and the auxiliary slide 27. Here, the sealing ring 30 is inserted in an axially open, lower ring-shaped groove 31 of the auxiliary slide 27.

It is also possible for one or more further sealing rings 32, 33 to be provided on the outer circumference of the auxiliary slide 27 in order to seal off the gap between the drum 1 and the auxiliary slide 27 too.

The drum 1 has solids discharge openings 34, 35 at two regions that are radially spaced apart from one another. The openings are in each case formed to be circumferentially distributed in the drum shell—here, in the drum lower part 2 and also in the drum middle part 3. The lower solids discharge openings 34 are situated in the region of the largest inner diameter of the lower centrifuging chamber 21, and the upper solids discharge openings 35 are situated in the region of the largest inner diameter of the upper centrifuging chamber 22.

In an upper position, the auxiliary slide 27 closes off the upper solids discharge openings 35. In this position, it bears against the drum cover 4. Also, in a lower position, the auxiliary slide 27 opens up the upper solids discharge openings 35. In this position, it correspondingly no longer bears against the drum cover 4 at the bottom.

By contrast, in an upper position, the piston slide 26 closes off the lower solids discharge openings 34 and, in a lower position, opens them up. By contrast to the situation with a nozzle separator, in which the outlet nozzles for a solids phase are open at all times, the outlet openings for the solids phase in a separator having a piston slide 26 are open only intermittently.

In the upper position, the piston slide 26 bears against the auxiliary slide 27 at the bottom. If the piston slide is moved into a lower position, the lower solids discharge openings 34 are exposed, with the result that evacuation of solids from the lower centrifuging chamber 21 occurs until the auxiliary slide 27 moves downward (inter alia because the latter is subjected to pressure from above in the upper centrifuging chamber 22), wherein the auxiliary slide closes off the lower solids discharge openings 34 and opens up the upper solids discharge openings 35, with the result that evacuation of solids from the upper centrifuging chamber 22 takes place.

Such evacuation of solids, initially of the lower centrifuging chamber 21 and then of the upper centrifuging chamber 22, is ended overall in that the piston slide 26 is moved into its upper position again, wherein it displaces the auxiliary slide 27 upward along therewith, wherein the upper solids discharge openings 35 are also closed again.

An actuating mechanism serves for moving the internal piston slide 26. The mechanism is based on a hydraulic operating principle. For the realization thereof, a pressure chamber 36 that is able to be charged with a fluid is formed below the lower piston slide 26.

The pressure chamber 36 is able to be charged by way of at least one line with a fluid, in particular a liquid, such as water, which can, at the spindle, be injected into a duct 38 in the drum 1 through at least one inflow line 37, the duct opening into the pressure chamber 36. A control device (not illustrated here) for controlling and providing the liquid is connected upstream of the inflow line 37. Such control devices for feeding liquid (hydraulic fluid) into a drum 1 for the purpose of moving a piston slide 26 are known per se.

Injection of liquid into the pressure chamber 36 allows the piston slide 26 to be moved into the vertically upper position (this position being illustrated on the right of the axis of rotation).

By contrast, draining the liquid from the pressure chamber 36, for example with the aid of a switchover of a valve 39 at the duct 38, allows the liquid to be drained from the pressure chamber 36, with the result that the piston slide 26 moves into the vertically lower position (this position being illustrated on the left of the axis of rotation) as a result of the pressure, acting on the slide from above, in the lower centrifuging chamber 21.

The selected and described design with the piston slide 26 and the auxiliary slide 27 assigned thereto is of simple construction and nevertheless functions very well. Here, in particular the seal between the partitioning plate 23 and the auxiliary slide 27 should also be emphasized as being advantageous.

The outlet opening(s) 19 out of the distributor ducts are situated below one or, if appropriate, multiple rising ducts 40 in the lower separating plate assembly 24, which is arranged in the lower centrifuging chamber 21. The at least one rising duct 40 is situated in the lower separating plate assembly 24 preferably relatively far to the outside radially, in particular in the radially outer half of the lower separating plate assembly 24.

A flowable product entering the separating plate assembly 24 in the lower centrifuging chamber 21 through the rising duct 40 is clarified of solids in this separating plate assembly 24. In this way, solids flow outward out of the separating plate assembly 24 and accumulate in the region of the largest inner diameter. By contrast, the clarified liquid flows radially inward. The solids accumulating on the outside in the lower centrifuging chamber 21 are, as described previously, evacuated from time to time.

The clarified liquid, which flows radially inward, is conducted vertically upward in a duct 49, which extends axially on the outside of the distributor shaft 16 (and thus radially on the inside in the drum inner chamber 20), up to the partitioning plate 23, which is mounted on the distributor shaft 15 on the outside in a rotationally conjoint manner.

The partitioning plate 23 is provided with one or more distribution ducts 41. The distribution ducts 41 are directed radially outward and conduct the clarified phase into the upper centrifuging chamber 22 out of the lower centrifuging chamber. For this purpose, the distribution ducts 41 have outlet openings 42. The outlet openings 42 are aligned with one or more rising ducts 43 in the upper separating plate assembly 25, which is arranged in the upper centrifuging chamber 22.

The position of the rising ducts 43 in the upper separating plate assembly 25 may be selected independently of the position of the rising ducts 40 in the separating plate assembly 24 in the lower centrifuging chamber 21. The position is obtained depending on the liquid phases of different density that are to be separated (for example L1 and L2).

Clarifying of remaining solids in turn takes place in the upper centrifuging chamber 22. The solids flow radially outward in the upper centrifuging chamber 22, accumulate there outside the upper separating plate assembly 25 and can from time to time be ejected out of the solids discharge openings 35 by solids evacuations (in particular in the manner described further above).

The clarified liquid is either drained through a single skimming plate (not illustrated here in this way), in which case the upper centrifuging chamber would be formed exclusively as a clarifier, or alternatively—and preferably—the clarified liquid in the upper centrifuging chamber is not only clarified but also separated into two phases of different density (for example skimmed milk and cream). These two separated liquid phases are conducted out of the drum 1 through two liquid discharges.

Preferably, the liquid discharges are in the form of skimming plates 44, 45 which are arranged vertically one above the other in skimming chambers 46, 47 within a drum covering 50 on the drum upper part 4. The one skimming plate 44 (here, the lower one) serves for the discharge of the lighter liquid phase L1, which is conducted radially further inward into the one skimming plate of the skimming plates 46, and the other skimming plate 45 (here, the upper one) serves for the discharge of the heavier liquid phase L2. This is removed at a larger radius, for example via an outer circumferential edge of a separation plate 48 through at least one duct 51, and conducted into the upper skimming chamber 47. The skimming chambers 46, 47 work according to the operating principle of centripetal pumps. They do not rotate with the drum 1, but rather are fastened to the inflow pipe 14. In FIG. 1, these parts are thus those parts that do not belong to the rotating system. Furthermore, by definition, the rotating drive spindle 5 is also not included in this rotating system.

During operation, the material for centrifuging, or product, to be clarified—for example milk—is conducted into the rotating system through the central inflow pipe 14, which does not rotate during operation, in the region of the distributor 16.

In the lower separating plate assembly 24, the material for centrifuging is clarified of solids. The product clarified in this way flows into the upper centrifuging chamber 22. In the upper centrifuging chamber 22, further clarifying of remaining solids takes place, and the two liquid phases of different specific weight are separated from one another (into cream and skimmed milk, in the case of milk).

Of particular advantage is the above-described possibility of two-stage clarification in only one single drum 1 having two substantially separated centrifuging chambers 21, 22.

The liquid phase L1 with the lower specific weight—the cream, in the case of milk—is conducted inward into the first skimming chamber 46 and, from there, conducted out of the rotating system by way of the first skimming plate 44. By contrast, the liquid phase L2 with the higher specific weight—the skimmed milk, in the case of milk—is conducted out of the rotating system through the upper skimming chamber 47 by way of the second skimming plate 45.

The separating plates of the two plate assemblies 24, 25 in each case include an angle $\alpha$ with the axis of rotation D (see also FIG. 2 on the right of the axis of rotation). They also have a radius r2 (equal here). The angle of the internal conicity of the centrifuging chamber corresponds to $\beta$.

The maximum height from the lowest part of the rotating drum lower part 2 to the highest point of the rotating drum cover 4 (together with the drum covering 50 of the latter) is referred to below as the height h of the rotating system. The largest diameter is the largest diameter d of the drum 1, which in this case corresponds to the diameter of the drum middle part 3 (see FIG. 2). The maximum radius of the centrifuging chambers corresponds to r1.

In order then to obtain a largest possible diameter of the separating plates under the predefined edge conditions such as height h, diameter d, plate angle $\alpha$, conicity $\beta$ and radius r1, the "two-fold double hollow cone" proves to be highly advantageous.

FIG. 2 also shows well that, when the drum 1 is configured as a "two-fold double hollow cone" having two centrifuging chambers 21, 22, arranged one above the other, inside a single drum 1, which chambers are preferably connected only by a line in the partitioning plate 23 for conducting clarified phase from the lower centrifuging chamber to the upper centrifuging chamber 22, wider separating plates (having a larger radius $r_2$) are able to be used than in a drum of the same height and same radius (left part of FIG. 2) having only a single double-conical centrifuging chamber, where the separating plates have to have a smaller radius r3<r2 in order not to be too close to the drum inner wall. The conicity angle $\alpha$ of the plates of the separating plate assemblies 24, 25 cannot be selected arbitrarily, but must be larger than the slope angle required for the solids, which are to be separated, in order that these can outwardly slide on the separating plates well.

A characterizing feature in this design having two centrifuging chambers 21, 22, arranged one above the other, inside a single drum 1 is that the mass moment of inertia $J_Q$ about a transverse axis Q extending through the center of gravity S of the rotating system and which is perpendicular to the axis of rotation D is greater than the mass moment of inertia $J_D$ about the axis of rotation D (see FIG. 2 for this purpose).

In summary, it should be noted that, by way of the two-stage configuration of the drum inner chamber 20 having two centrifuging chambers 21, 22 arranged one above the other, a clarifying surface that is very large relative to the height and diameter of the drum inner chamber 20 is able to be realized overall. This is achieved by the height h of the drum 1, which is relatively large compared with the diameter d.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

REFERENCE SIGNS

Drum 1
Drum lower part 2
Drum middle part 3
Drum cover 4
Drive spindle 5
Screw 6
Section 7
Thread 8
Ring collar 9
Ring collar 10
Ring collar 11
Closure ring 12
Thread 13
Inflow pipe 14
Distributor shaft 15
Distributor 16
Distributor section 17
Distributor ducts 18

Outlet opening 19
Drum inner chamber 20
Sections 20*a-d*
Centrifuging chambers 21, 22
Partitioning plate 23
Separating plate assemblies 24, 25
Piston slide 26
Section 26*a*
Seal 26*b*
Auxiliary slide 27
Sections 27*a, b*
Sealing ring 28
Ring-shaped groove 29
Sealing ring 30
Ring-shaped groove 31
Sealing rings 32, 33
Solids discharge openings 34, 35
Pressure chamber 36
Inflow line 37
Duct 38
Valve 39
Rising ducts 40
Distribution ducts 41
Outlet openings 42
Rising ducts 43
Skimming plates 44, 45
Skimming chambers 46, 47
Separation plate 48
Duct 49
Drum covering 50
Duct 51
Radii r1, r2, r3
Angles α, β
Axis of rotation D
Axis Q
Center of gravity S
Diameter d
Height h
Light liquid phase L1
Heavy liquid phase L2

The invention claimed is:

1. A separator, comprising:

a rotating system, which comprises a drum with a vertical axis of rotation, wherein the drum is rotatable during operation and has a drum inner chamber, which is subdivided into a lower double-conical centrifuging chamber and an upper double-conical centrifuging chamber, wherein the lower and upper double-conical centrifuging chambers each have solids discharge openings, which are openable and closable in the lower centrifuging chamber by a piston slide and in the upper centrifuging chamber by an auxiliary slide, wherein a mass moment of inertia of the rotating system about a transverse axis extending through a center of gravity of the rotating system of the drum and which is perpendicular to the vertical axis of rotation is greater than a mass moment of inertia of the rotating system about the vertical axis of rotation of the rotating system, wherein the drum inner chamber is subdivided by a conical partitioning plate into the lower double-conical centrifuging chamber and the upper double-conical centrifuging chamber, and wherein the auxiliary slide has a double-conical form, and a sealing ring is formed between the conical partitioning plate and the auxiliary slide.

2. The separator of claim 1, wherein the conical partitioning plate has a distribution duct for conducting clarified product into the upper centrifuging chamber from the lower centrifuging chamber.

3. The separator of claim 1, wherein the conical partitioning plate bears against an outer circumference of the auxiliary slide directly and/or indirectly via a sealing ring, and the conical partitioning plate extends radially inward up to a distributor.

4. The separator of claim 1, wherein the conical partitioning plate extends radially inward up to a distributor.

5. The separator of claim 1, wherein, in a region of the lower centrifuging chamber, the drum is configured as a clarifier for clarifying a flowable product of solids, and, in a region of the upper centrifuging chamber, the drum is configured as a clarifier, or as a combined clarifier and separator both for clarifying a flowable product of solids and for separating the product into liquid phases of different density.

6. The separator of claim 1, wherein the drum has two centrifugal clarifiers which are connected in series.

7. The separator of claim 1, wherein a lower separating plate assembly is formed in the lower centrifuging chamber and an upper separating plate assembly is formed in the upper centrifuging chamber, wherein the lower and upper separating plate assemblies each have one or more rising ducts.

8. The separator of claim 7, wherein all the rising ducts of the lower separating plate assembly are situated at a different radius than all the rising ducts of the upper separating plate assembly.

9. The separator of claim 1, wherein the drum has a drum lower part, a drum middle part, and a drum upper part or a drum cover, which are arranged vertically one above the other.

10. The separator of claim 9, wherein the drum upper part is conical at least in sections, the drum middle part is an externally and internally cylindrical ring segment, and the drum lower part is conical at least internally in sections.

11. The separator of claim 9, wherein the drum cover has a drum covering closing off the rotating system in a vertically upward direction.

12. The separator of claim 1, wherein the sealing ring bears directly against the auxiliary slide in a region of a smallest inner diameter of the auxiliary slide.

* * * * *